US005771983A

United States Patent [19]

Rottmann

[11] Patent Number: 5,771,983

[45] Date of Patent: Jun. 30, 1998

[54] SCREW CLAMP WITH U-SHAPED CLAMP PART

[75] Inventor: Hans-Peter Rottmann, Altbach, Germany

[73] Assignee: Richard Hirschmann GmbH & Co., Germany

[21] Appl. No.: 307,705

[22] PCT Filed: May 26, 1994

[86] PCT No.: PCT/EP94/01716

§ 371 Date: Jan. 11, 1996

§ 102(e) Date: Jan. 11, 1996

[87] PCT Pub. No.: WO95/02262

PCT Pub. Date: Jan. 19, 1995

[30] Foreign Application Priority Data

Jul. 8, 1993 [DE] Germany ..... 43 22 790.2

[51] Int. Cl.[6] ..... H01R 4/36

[52] U.S. Cl. ..... 174/84 C; 174/845; 439/877

[58] Field of Search ..... 174/84 C, 84 R, 174/84 S; 439/98, 877, 882

[56] References Cited

U.S. PATENT DOCUMENTS 3,694,564 9/1972 Pater ..... 174/84 C

FOREIGN PATENT DOCUMENTS 0 023 234 2/1981 European Pat. Off. .
0 337 236 10/1989 European Pat. Off. .
1 289 114 2/1962 France .
15 66 270 5/1969 France .
2 503 939 10/1982 France .
GM 1808756 3/1960 Germany .
AS 1107755 1/1961 Germany .
GM 1835455 7/1961 Germany .
20 11 081 9/1970 Germany .
25 51 300 B2 1/1978 Germany .
84 02 382 4/1984 Germany .

*Primary Examiner*—Kristine L. Kincaid
*Assistant Examiner*—Marc D. Machtinger
*Attorney, Agent, or Firm*—Fulbright & Jaworski LLP

[57] ABSTRACT

In a screw clamp (2) for connecting electrical conductors (36), the clamp body has a U-shaped sheet-metal component (4) between the arm sections (5, 6) of which is held a nut (9) to accept a clamping screw (11) and in which the end section (12) of the first arm section (5) is bent through 90° towards the second arm section (6), bears upon the latter and has an opening (17) though which the clamping screw (11) can be inserted. To improve the mechanical strength of such a screw clamp (2) while at the same time reducing its structural height, the end section (15) of the second arm section (6) is also bent towards the first arm section (5) and has a screw opening (18), with the two end sections (12, 15) and the nut (9) being in mutual contact. This screw clamp is suitable for particularly high loading owing to lateral extensions (24, 25) of the outer end section (12) which transfix suitable recesses (27) in the inner end section (15) and mutually engage, and owing to a widening of the bridge (23) between the recess (7) and the screw opening (18) in the inner end section (15).

7 Claims, 2 Drawing Sheets

SCREW CLAMP WITH U-SHAPED CLAMP PART

BACKGROUND OF THE INVENTION

Field of the Invention

This invention relates to a screw clamp for connecting electrical conductors.

European patent 0 023 234 suggests one type of screw terminal for connecting electrical conductors. That screw terminal is used, for example, in conjunction with a one-piece molded receptacle as the contact element for a cable connector. No thread grooves can be made from the thin spring steel sheet necessary for those screw terminals, and the required tightening torque cannot be attained with a simple hole for accommodating the terminal screw. Therefore, between two leg sections of the screw terminal there is a sufficiently thick nut (cross nut) that is held using side shoulders in recesses of the two leg sections. In this way the leg section clearance can be reduced to the diameter of the threaded hole and thus a minimum width of the screw terminal can be achieved, preferably the diameter of the screw head corresponding at most to this width.

In this screw terminal however, a relatively large leg length is necessary in order that the leg part between the recesses and the free upper edge is thick enough to be able to accommodate the clamping forces produced by the required tightening torque of the terminal screw. For this reason, the terminal height (i.e., the dimension in the direction of the screw axis) is too large for many applications, especially for use in miniature connectors.

In addition, in the known screw terminal, under high clamping forces, the leg sections can be pressed apart by more than the material thickness of the sheet metal, therefore the cross nut is withdrawn at least from one recess, and reliable terminal contact is no longer guaranteed. Frequently, the screw terminal in this process is deformed so that it is unusable.

An advantage of this screw clamp is that it is simple and inexpensive. Another advantage is that the screw clamp has stability in the direction of the screw axis, the terminal height is reduced, and spreading of the terminal arm sections is reliably prevented even under high clamping forces.

This screw clamp structure, which is implemented with a minimum additional cost compared to previous structures, makes it possible to arrange the inside surface of the end part of the second arm section to be supported directly on the cross nut so that the range of heights necessary to accommodate the clamping forces is reduced to twice the material thickness of the sheet metal part. Thus, the clamp dimensions are reduced not only in width but also in height to an absolute minimum by which the range of application of the screw terminal is greatly increased. This screw clamp can, for example, be used in miniature connectors with contact carriers in cross section that have various small contact cavities for holding one-piece contacts with the screw terminal connection.

Moreover, by means of the aligned screw openings of the inner and outer end part of the two arm sections, which preferably correspond to the outside diameter of the threaded shaft of the terminal screw or which are at least slightly larger, lateral yielding of the arm sections, at least in the area of the recesses adjacent to the end parts, is suppressed both simply and effectively so that even with very large clamping forces, the mechanical stability of the screw terminal is reliably guaranteed on a permanent basis.

The design also easily and simply prevents the arm sections from springing to the outside before inserting and screwing down the clamp screw. This greatly facilitates assembly. In addition, the extensions bent into the recesses result in the fact that the two end parts of the arm sections lie next to one another transversely to the screw axis in the target position and are held together -- in this way, they can be easily inserted into the recesses of equipment parts, said recesses adapted to the target cross sectional outline, for example, to the contact cavities of a connector-contact carrier; this likewise contributes to easy assembly. One such screw terminal is thus especially well suited for mechanical mass production of products such as connectors.

Furthermore, securely holding the end parts together prevents the outer end part from folding upwards at higher tightening torques. The extensions could fundamentally also be molded onto the inner end part and provide for insertion into recesses of the outer end part. In this version, however, the lugs that project over the outer end part would again make the terminal height greater. The arrangement in which the lugs project into the free space between the two arm sections on their longitudinal ends conversely has the advantage that the minimum terminal height is preserved. For many cases, a lug that projects laterally on each extension is adequate. An especially high retaining force and exactly parallel position of the two parts to one another are achieved with extremely low additional material cost by lugs (or a double lug) adjacent to both sides to the neck.

At the minimum width of the U-shaped clamp part, the clearance of the arm sections corresponds to the outside diameter of the threaded shaft of the terminal screw. After the cross nut sits against the inner surface of the inner end part of the second arm section with minimum additional terminal height, on the bending edge of the second arm section between the recess boundary edge facing it and the, for example, circular bushing, there remains only a narrow bending bridge. On the front free end of the inner end part where the bushing runs tangentially to the front edge there is essentially no bridge. The danger, therefore, is great that the screw clamp will not withstand the loads at these points under high tightening torques, and the narrow bridges will rupture. The site on the front free end of the inner end part, moreover, cannot be reliably controlled in production engineering.

To prevent this danger, however, advantageous measure are included.

By forming the opening of the inner end part the bending bridge is greatly widened by the height of the remaining circular segment that corresponds to the difference between the outside radius of the threaded shaft and it core radius. In this way, the acquired widening is maximized and the remaining circular segment fits as a screw brake and screw locking device into the screw thread.

Another improvement in the stability of the bending bridge by widening is included. By means of the arrangement and dimensioning of the jog, it bends equally in area with the inner end part and thus widens the bending bridge by the material thickness of the sheet metal part without projecting out laterally beyond the second arm section so that the minimum width of the U-shaped clamp part is preserved. This bending bridge widened in such an extremely simple and cost favorable manner withstands the mechanical loads that occur under the strongest clamping forces.

By an additional design of the opening of the inner end part the sheet metal part is suitable, for example, in punching processes without additional costs for series production, because no undefined thin bridges or tips can occur. Sickle-shaped claws, surrounding the screw shaft and formed by slightly shortening the inner end part, are relatively durable and are also reliably protected against opening under the action of high clamping forces.

BRIEF DESCRIPTION OF THE DRAWINGS

The design is detailed below in the figures using an embodiment formed as a terminal bushing for a cable connector.

DETAILED DESCRIPTION OF THE PREFERRED EMBODIMENT

Figure 1:
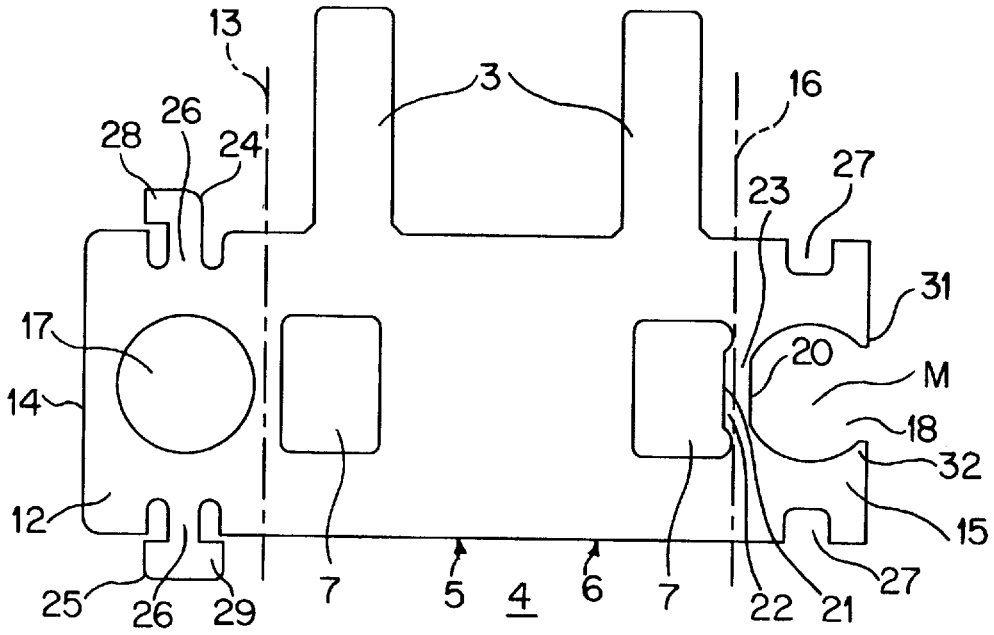
FIG. 1 shows a view of the sheet metal part of the screw clamp.
Figure 2A:
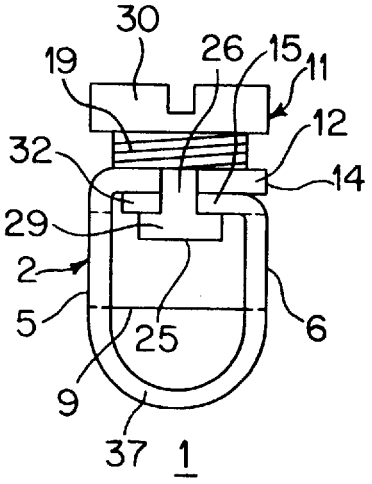
FIG. 2*a* shows a front view of the terminal bushing with a terminal screw.
Figure 2B:
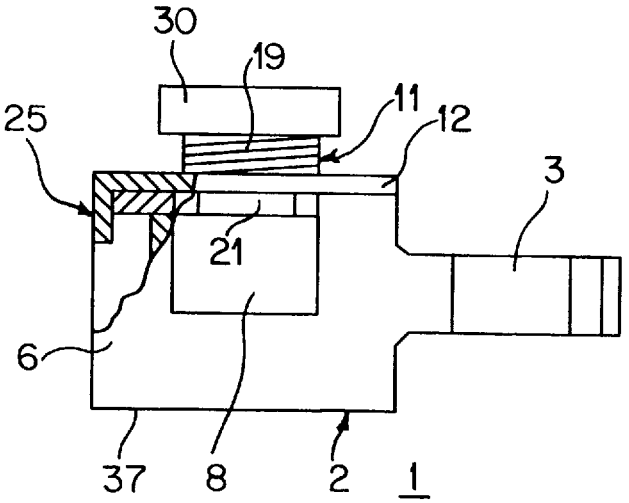
Figure 3:
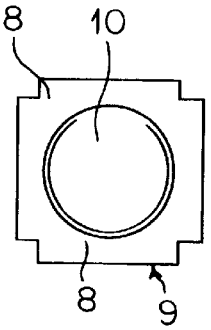
FIG. 3 shows an overhead view of the cross nut, not installed.
Figure 2C:
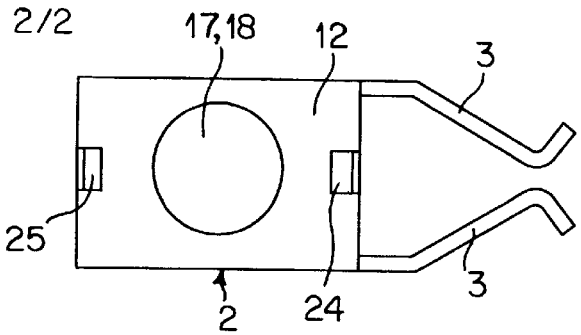

FIG. 1 shows a view of the sheet metal part of the screw clamp. FIG. 2*a* shows a front view of the terminal bushing with a terminal screw. FIG. 2*b* shows a lateral view of the terminal bushing with a terminal screw. FIG. 2*c* shows an overhead view of the terminal bushing without a terminal screw. FIG. 3 shows an overhead view of the cross nut, not installed.

Terminal bushing 1 has terminal screw 2 and two fork springs 3 that form a receptacle contact and that are molded in one piece to the terminal. Screw terminal 2 has U-shaped spring steel sheet metal part 4 (shown in FIG. 1 ) that is produced in a punching and bending process, with two arm sections 5, 6 in each of which there is recess 7, into which shoulders 8 of cross nut 9, which lie opposite one another, fit with central threaded hole 10 to accommodate terminal screw 11 to such an extent that they are flush with the outside wall of arm sections 5, 6. In this way, not only is the cross nut 9 stably retained, but it is also possible to adapt the clearance between arm sections 5, 6 to the screw diameter and thus minimize the terminal width.

One end part 12 of first arm section 5 is bent by 90° around first bending edge 13 towards second arm section 6. The front edge 14 is flush with the outside wall of second arm section 6. One end part 15 of second arm section 6 is likewise bent 90° towards first arm section 5 around second bending edge 16 and is located between outer end part 12 and cross nut 9. Outer end part 12 lies on inner end part 15 and the latter in turn on cross nut 9 so that the clamp height is low yet has high stability.

Two end parts 12, 15 each bear central openings 17, 18 for terminal screw 11. Opening 17 of outer end part 12 of first arm section 15 is circular with the diameter of the circle corresponding to the outside diameter of threaded shaft 19 of terminal screw 11. Opening 18 of inner end part 15 of second arm section 6 in a central area is likewise circular with the indicated diameter; in the area facing bending edge 16, the circle is shortened by a segment with chord 20 parallel to bending edge 16, which has a distance corresponding to the core radium of threaded shaft 19 from the center of the circle M. In addition, boundary edge 21 of recess 7 facing bending edge 16 has jog 22 that corresponds to the material thickness of sheet metal part 4 so that between recess 7 and opening 18 a relatively wide and stable bridge 23 is formed, which also effectively prevents rupture of sheet metal part 4 at this point even under high clamping forces. In addition, bridge 23 fits into the thread of clamp screw 11 by virtue of the indicated dimensioning and at the same time forms a screw locking device.

The mechanical strength of screw clamp 2 is further increased by extensions 24, 25 which project in one piece from outer end part 12 of arm section 5 and which, bent by roughly 90°, each penetrate with their neck parts 26 corresponding to recess 27 of inner end part 15. The extensions fit behind the inner edge areas of recesses 27 with single lug 28 or double lug 29, which runs transversely to neck part 26, without projecting above screw terminal 2.

The diameter of screw head 30 has a size corresponding to the terminal width such that it does not increase the terminal dimensions and nevertheless can convert the total tightening torque into clamping force.

The distance of center point M of opening 18 of inner end part 15 from its free front edge 31 is smaller than the diameter of the circle, so that a circular opening of roughly two-thirds of the circle diameter arises by which two sickle-shaped claws 32 are formed which encompass the screw. This version is, moreover, much more easily managed in terms of production engineering than a opening that touches the front edge if the diameter of threaded shaft 19 is equal to the arm clearance.

Figure 4:
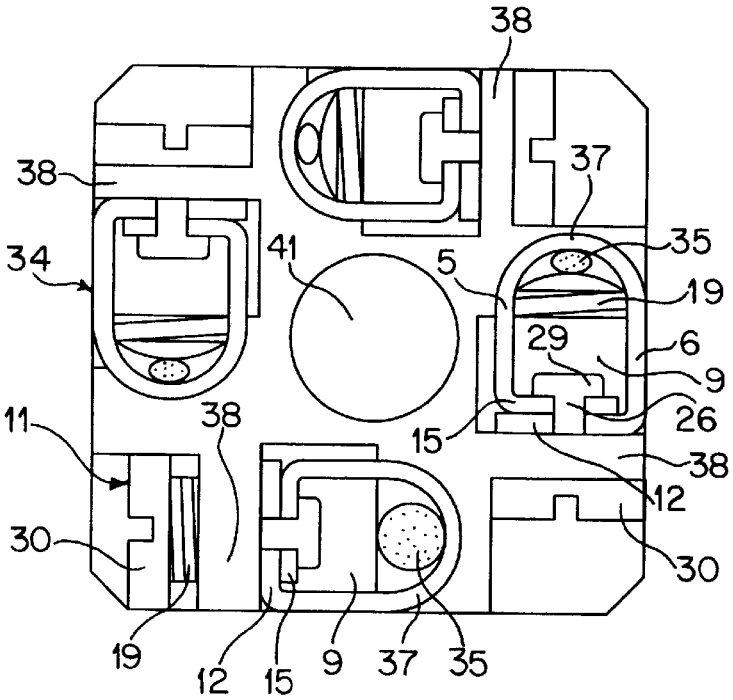
FIG. 4 shows a connection-side front view of the connector-contact carrier with the terminal bushings inserted.
Figure 5:
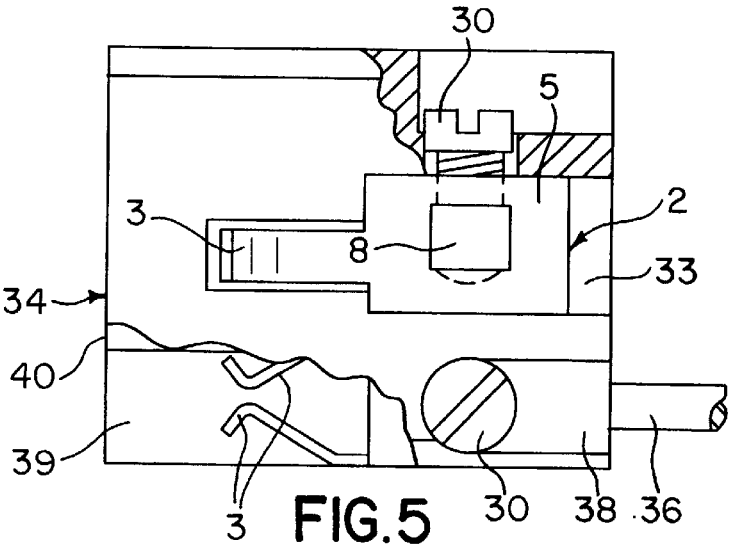
FIG. 5 shows a partially cutaway side view of the contact carrier with terminal bushings inserted.

FIG. 4 shows a connection-side front view of the connector-contact carrier with the terminal bushings inserted. FIG. 5 shows a partially cutaway side view of the contact carrier with terminal bushings inserted. Four of the terminal bushings shown in FIGS. 1-3 are located in contact cavities 33 of contact carrier 34 of a miniature plug. Stripped ends 35 of pertinent stranded wires 36 are each inserted between cross nut 9 and arched bottom part 37 of U-shaped sheet metal part 4 and are terminal-contacted by terminal screw 11, which is turned transversely to the direction of insertion. Screw head 30 in this case lies in a matched hole of wall 38 of contact carrier 34, the wall being adjacent to the outside surface of end part 12 of first arm section 5. At the same time, the terminal bushing is held in contact cavity 33.

To insert contact pins of a mating connector which is not shown in the elongation of contact cavities 33 there are slots 39 that extend toward front side 40 of contact carrier 34. To attach the contact carrier in a housing of the miniature plug which is not shown by means of the central screw, contact carrier 34 has central hole 41.

Overall, by means of the described features, a screw clamp that can be used, for example, in a terminal sleeve can be formed with extremely low cost, but which, in spite of minimum dimensions, has high stability.

I claim:

1. A screw terminal for connecting electrical conductors comprising:

a U-shaped sheet metal part;

a cross nut between a first arm section and a second arm section held using side shoulders in a recess of the first arm section and a recess of the second arm section and located transversely to the first arm section and the second arm section for holding and guiding a threaded shaft of a terminal screw;

an outer end part of the first arm section bent by 90° towards the second arm section, wherein the outer end part of the first arm section lies on the second arm section and has a central hole for penetration of the threaded shaft of the terminal screw;

an inner end part of the second arm section bent 90° towards the first arm section around a bending edge, wherein the inner end part rests flat against the outer end part and has an opening that is flush with the central hole of the outer end part for penetration of the threaded shaft of the terminal screw.

2. A screw terminal according to claim 1, wherein the outer end part of the first arm section between the first arm section and the second arm section bears one-piece extensions with a neck and at least one lug that projects laterally from the neck, and wherein the extensions, which are bent 90° when the screw terminal is installed, align with the neck corresponding to recesses of the inner end part and fit behind inner edge parts of the recesses of the inner end part with said at least one lug.

3. A screw terminal according to claim 1, wherein the opening of the inner end part in cross section is the flat segment of a circle with a chord that runs parallel to the bending edge and has a distance at least roughly corresponding to the core radium of the threaded shaft from a center point of the circle.

4. A screw terminal according to claim 1, wherein the recess in the second arm section further comprises a boundary edge defining a Jog between the boundary edge and the bending edge, and wherein the boundary edge and the bending edge are separated by a distance substantially equal to the thickness of the sheet metal part.

5. A screw terminal according to claim 1, wherein the opening of the inner end part in cross section is an unclosed circle in which the distance of a center point from a front edge of the inner end part, the front edge being parallel to a wall of the second arm section, is less than a radius corresponding to an outside diameter of the threaded shaft of the terminal screw.

6. A screw terminal according to claim 1, further comprising a locking mechanism connected to the outer end part and the inner end part.

7. A screw terminal according to claim 1, wherein the terminal screw penetrates the central hole of the outer end part, the opening of the inner end part, and the cross nut.

* * * * *